United States Patent [19]

Tinsley

[11] Patent Number: 4,570,419

[45] Date of Patent: Feb. 18, 1986

[54] MEASURING AND TRANSFER SYSTEM

[76] Inventor: Charles E. Tinsley, Ventura, Calif. 93003

[21] Appl. No.: 550,928

[22] Filed: Nov. 10, 1983

[51] Int. Cl.[4] ..... B65B 1/06; B65B 1/36; B65B 39/12

[52] U.S. Cl. ..... 53/473; 53/247; 53/248; 53/260; 53/503; 221/251

[58] Field of Search ..... 53/472, 474, 475, 473, 53/260, 255, 245, 247, 248, 249, 503, 535, 536; 414/293, 294; 222/564, 527; 221/251

[56] References Cited

U.S. PATENT DOCUMENTS

| | | | |
|---|---|---|---|
| 2,896,384 | 7/1959 | Carlsen et al. | 53/245 X |
| 2,933,872 | 4/1960 | Pollmann | 53/249 X |
| 3,021,656 | 2/1962 | Vries | 53/260 X |
| 3,322,289 | 5/1967 | Wendell et al. | 414/293 |
| 3,478,484 | 11/1969 | Betz | 53/255 X |
| 3,864,893 | 2/1975 | Murao | 53/503 |
| 4,250,690 | 2/1981 | Lorenzen et al. | 53/503 X |

FOREIGN PATENT DOCUMENTS

| | | | |
|---|---|---|---|
| 943039 | 5/1956 | Fed. Rep. of Germany | 53/249 |
| 783132 | 12/1980 | U.S.S.R. | 53/260 |

*Primary Examiner*—Horace M. Culver

*Attorney, Agent, or Firm*—Poms, Smith, Lande & Rose

[57] ABSTRACT

A movable carriage or receptacle receives lemons or other products from a conveyor or the like, and as a quantity sufficient to fill a box or container is accumulated, the receptacle or carriage moves down to the box, with the fragile product being gently layered into the carriage or receptacle; and then the lower door of the carriage or receptacle opens slowly to completely fill the box or other container, with the product again being layered gently into the box with no dropping so that the boxes are packed full without damage to the product. An alternate arrangement uses a pivotal support member and an associated product feeding member to accomplish the same functions. Through the use of a triangular receptacle or carriage, with the final measurement taking place near the apex of the triangular space, very accurate measurement may be accomplished.

26 Claims, 8 Drawing Figures

MEASURING AND TRANSFER SYSTEM

FIELD OF THE INVENTION

This invention relates to techniques for packing fragile product.

BACKGROUND OF THE INVENTION

When lemons are being packed in boxes in certain current installations, the lemons are fed along a broad conveyor belt, and are often packed into the usual two compartment rectangular citrus boxes by manual labor. While a number of proposals have been made to mechanize this process, none have been widely accepted up to the present time. One of the problems involves the fact that lemons and other fruit are irregular in size and shape. Thus, even after grading for the size of the diameter, the variations in the length of the fruit may be significant, so that more counting of the fruit will not provide uniform packing of the boxes.

Accordingly an important object of the present invention is to provide a simple apparatus for automatically loading fragile products, such as fruit, into containers such as boxes, with the containers being filled evenly and uniformly and with no damage to the product.

In addition, the normal simple volumetric measurement of product tends to be quite inaccurate, resulting in large variations in the filling of product containers.

It is, therefore, another object of the invention to improve the accuracy of measurement of product which is being transferred.

SUMMARY OF THE INVENTION

In accordance with the present invention a moving support means is provided, which has a capacity equal to that of the container to be filled, and the support means moves down slowly as it receives the fragile product, to avoid damaging the product. When the support means has received a full complement of product, further flow to the supporting means is stopped, and a separate feeding means extends into the container to direct the product into the containers, again layering the product and avoiding any drops or bangs which could damage it.

In accordance with another aspect of the invention, a receptacle is provided, for the measurement and transfer of product, which is triangular in shape, or has another geometric configuration which diminishes toward the point where final loading occurs. As product is fed into the receptacle at least one wall thereof moves so that more product may be accepted in the receptacle, and finally the amount of product is measured at the final loading point. By this technique the relatively large volume corresponding to the capacity of the receptacle may be accurately controlled, at the final loading point where the angularly diminished cross-section at the apex of the triangular receptacle means that the addition of a little product will change the height of fill significantly.

In one preferred embodiment, a receptacle or carriage is provided which may receive product from a conveyor or the like on an upper level and moves downwardly to load the fragile product into a box or other container. The carriage or receptacle is open one one side, to receive fragile product which may be supplied from a conveyor or the like, and the receptacle or carriage is lowered toward the container while it continues to receive additional fragile product which is fed into the carriage or receptacle in a layered manner, with no dropping of the fragile product through any substantial distance. The amount of product supplied to the carriage or receptacle is accurately controlled in any desired manner, by weight, volume or any other desired technique. In one preferred arrangement, a photocell senses the product which builds up on a very gradually sloped feedway, and after a predetermined time interval following the blockage of the photo cell, a gate or door is raised to block further flow of fragile product from the feedway into the receptacle or carriage. The receptacle or carriage has a movable lower door or gate which is slowly opened once the receptacle or carriage has been lowered into proximity with a box or container to be filled. The slow lowering of the movable gate or door forming the bottom of the receptacle serves to feed the fragile product gently and in a layered manner into the container, as the lower gate or door extends into the container and acts as a feeding member to smoothly and gently feed and layer the product into the container. The carriage is then raised to its loading position, pulling the movable bottom gate or door out of the container, with the movable bottom door or gate then being restored to its normal upward position closing the bottom of the receptacle. The filled container is then moved out from under the receptacle and a new box or container is brought into position. The upper feedway door or gate is opened, and the accumulated fragile product rolls into the bottom level of the receptacle or carriage on top of the movable gate or bottom receptacle and the entire cycle is repeated.

Other features of the invention include the following:

(1) The use of pneumatic operating cylinders for controlling the process steps to facilitate the control of timing through restricting of flow through the pneumatic lines.

(2) The provision of an adjustable wall on the receptacle or carriage for the fragile product, so that its volume may be readily adjusted to fill the containers to any desired levels.

(3) The use of limit switches and photocells to accurately control the timing and cycling of the steps mentioned hereinabove.

(4) The orientation of the track or guideway for the movable carriage or receptacle at a angle such as 45° or 30° with respect to the vertical, to facilitate the loading of the receptacle and the measurement and feeding of the product into the container without dropping or damaging the product.

(5) The use of a sectioned receptacle or carriage for use with correspondingly sectioned containers.

(6) The use of two loading or feeding units to pack different products or materials, with the two units feeding either one into the other, or each feeding directly into a container.

Another embodiment of the invention involves the use of a support means which is pivoted at its upper end, and which has a supplemental feeding member pivoted to it at its lower end. Product is fed into a chamber which encloses the pivoted support member, and the controlled back-and-forth movement of the two pivoted members serves to gently fill the containers without damaging the fragile product. The construction and input feeding mechanism is such that the product is directed first to one side of the pivoted support member and in an alternate cycle, to the other side of the support member so that the containers or boxes are filled first from one side and then the other, with the feeding member in each case extending into the container and avoiding dropping of the fragile product, which could damage or bruise it.

Advantages of the invention include (1) very accurate and uniform measurement of bulk products, (2) simplified single stroke operation, (3) eliminating voids (4) ease of adjustment of quantity of products, (5) gentle handling and/or stacking of products, (6) level fill of product in the loaded containers, and (7) rapid cycle of operation.

Other objects, features and advantages of the invention will become apparent from a consideration of the following detailed description and the accompanying drawings.

DETAILED DESCRIPTION

Figure 1:
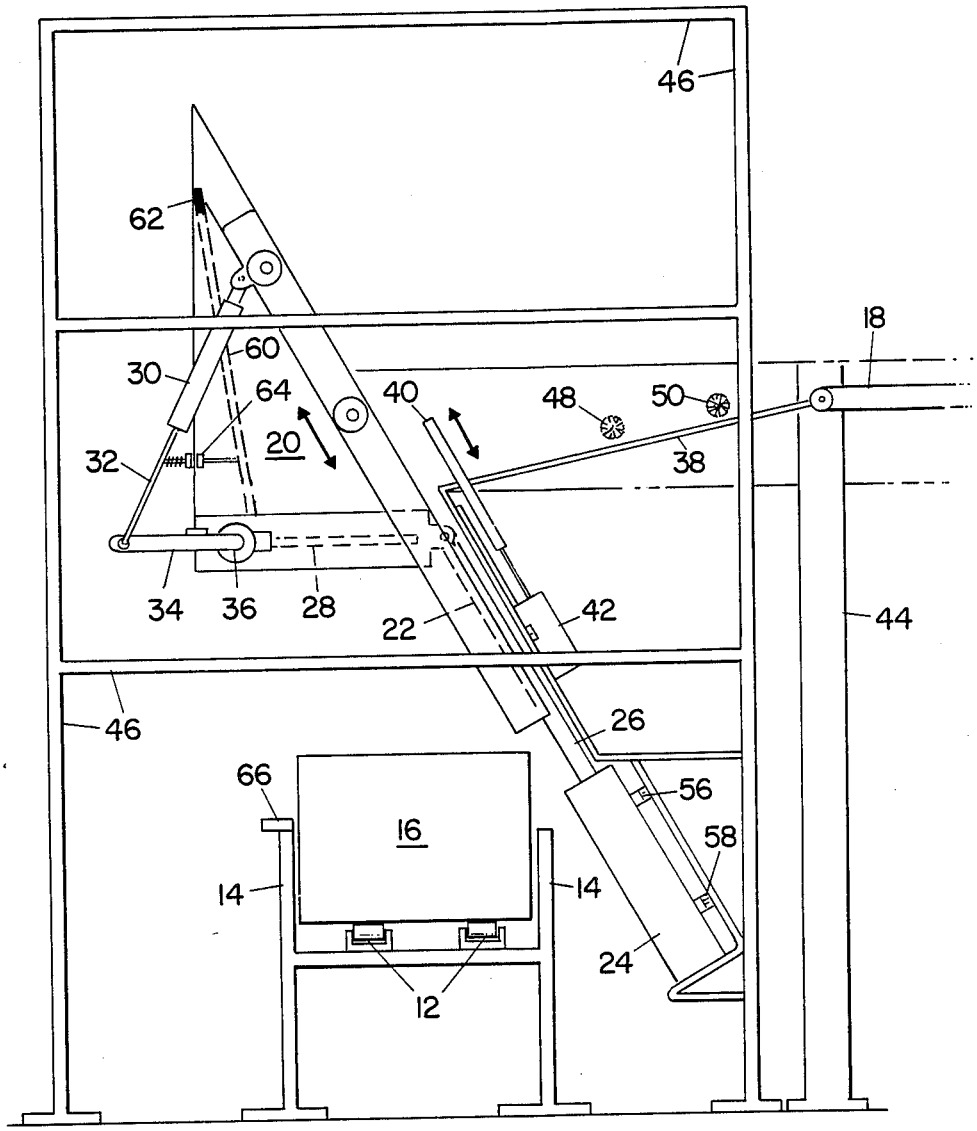
FIG. 1 is a side view of a loading or packing apparatus illustrating the principles of the present invention.

Referring more particularly to the drawings, in FIG. 1, the conveyor 12 with its side rails 14 supports a partitioned citrus fruit box 16 which is to be loaded with citrus fruit products such as lemons which are being supplied on a raised conveyor 18 which appears at the upper right in FIG. 1. A movable receptacle or carriage 20, which is generally triangular in cross-sectional configuration, is mounted to move along a tracks 22 under the control of the pneumatic cylinder 24 which is secured to the carriage 20 by the shaft 26. The carriage 20 may have plastic sliding elements, or wheels, which are captured by the incurved edges of the tracks 22. The bottom 28 of the carriage 20 is movable by the air cylinder 30 operating through the shaft 32 and the lever arm 34 to cause the pivoting gate or floor member 28 to rotate about its left hand edge, in the vicinity of pivot point 36.

Other components of the apparatus as shown in FIG. 1 include the feedway 38 along which fragile products, such as lemons, move from the conveyor 18 into the receptacle 20, and the door or gate 40 which is operated by the air cylinder 42 to block the flow of product from the feedway 38 into the receptacle 20. Suitable frame support members 44 for the conveyor 18, and 46 for the loading apparatus are also included in the showing of FIG. 1. Suitable photo-cells 48 and 50 are provided to sense the build-up of fruit on feedway 38. Brackets 56 and 58 secure the main operating cylinder 24 to the frame of the system.

In order to control the capacity of the receptacle or carriage 20, a plate 60, pivotally mounted at its upper edge 62, may be adjusted by the adjusting bolts 64 so that a greater or lesser amount of product may be loaded into the carriage 20.

Now, considering the mode of operation of the system, when the box 16 to be loaded reaches the proper position within the loading apparatus as determined by the limit switch 66 (see FIG. 2), the carriage 20 shifts to its upper position, the lower door or gate 28 at the bottom of receptacle 20 is in its up or closed position, and the upper door or gate 40 which blocks the output from feedway 38 is in its raised or closed position. The upper door 40 is then lowered and any accumulated fruit on the feedway 38 enters the receptacle or carriage 20 and rests on the movable bottom 28 of the carriage. As additional fruit is supplied by the conveyor 18, the fruit builds up in the carriage or receptacle 20 and backs up onto the feedway 38 so that it eventually blocks photocell 48 having a location which determines the loading quantity.

Following interruption of the photo cell 48, the main control pneumatic cylinder 24 is actuated or released to slowly lower the receptacle 20 until the lower gate or door 28 overlies the opened top of the box 16. Following a delay of about one second, the upper gate or door 40 is raised to block the flow of further product from the feedway 38. Once the carriage 20 reaches its lowest position, as detected by the limit switch LS-2, the pneumatic cylinder 30 is actuated to slowly open the movable bottom door or gate 28 at the bottom of receptacle 20. This permits the feeding of fruit into the box 16, under the control of the feeding member 28, which folds down into the opening of the container 16, preventing undue dropping and bruising of the fruit. When the gate 28 has fully opened, the main pneumatic cylinder 24 is actuated to move the carriage 20 upwardly, taking the pivotal member 28 with it, and as it is pulled out of the box 16, the final layers of fruit are properly located and fed gently into the box 16. Once the receptacle or carriage 20 reaches its upper position, and the fully loaded box of fruit is moved along the lower conveyor 12 to the new position 16″ and the new box 16′ comes into position, the entire cycle is repeated.

Figure 4:
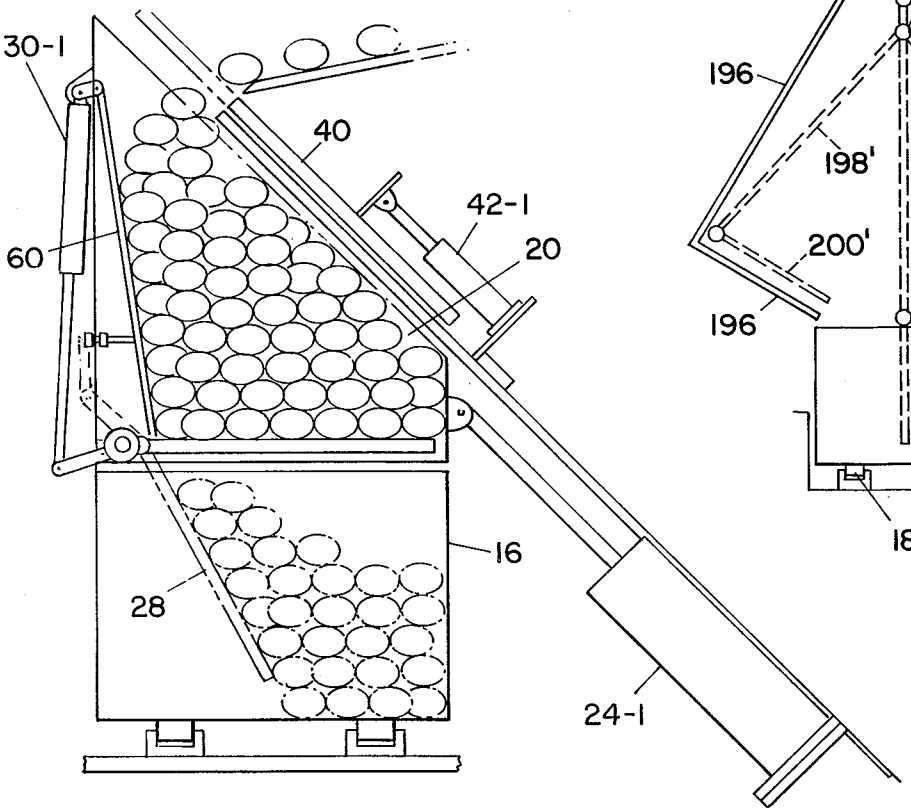
FIG. 4 is a diagrammatic showing indicating the loading step accomplished by an apparatus, illustrating one aspect of the invention.

Incidentally, the step of loading of the container 16, as the member 28 is pivotally lowered, may be more clearly observed from a consideration of FIG. 4 of the drawings, which shows a slightly different arrangement of parts, with the cylinder 30-1 in a different location from the cylinder 30 of FIG. 1.

Figure 2:
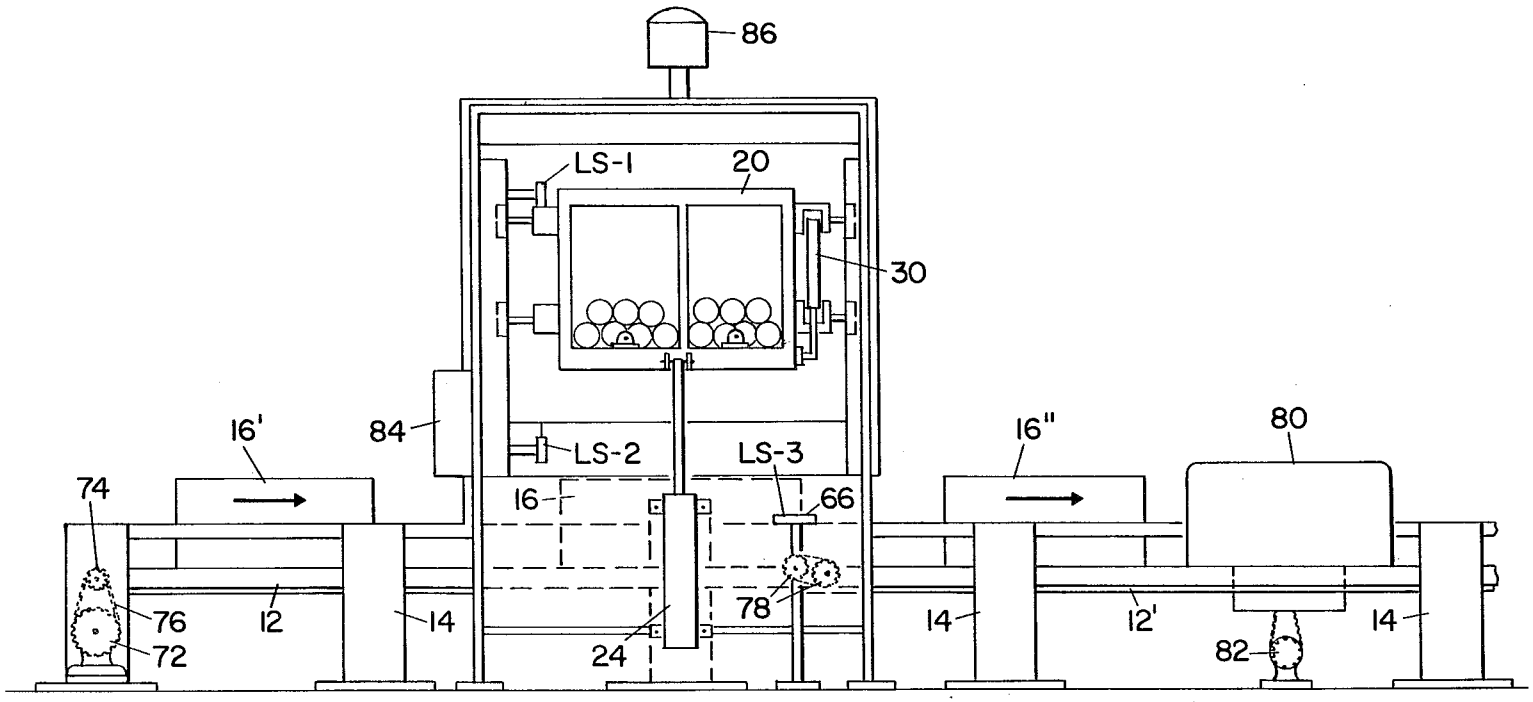
FIG. 2 is a rear view of the apparatus of FIG. 1 showing the conveyor system for moving empty boxes to the loading apparatus and filled boxes from it.

Now, considering FIG. 2, as mentioned above it is a rear view of the apparatus of FIG. 1. In FIG. 2, the box 16 is shown in place under the loading carriage or receptacle 20, with the empty box 16′ to the left on the conveyor 12, and the filled box 16″ to the right on the conveyor 12. Power for the conveyor 12 is supplied by the motor 72 through the sprocket 74 and the sprocket chain 76. Power is supplied from one conveyor 12 to the second conveyor 12′ by the inter-coupled sprockets 78. Associated with the limit switch 66 is a conventional stop for the box 16, which is released to permit movement of the box 16 from the indicated position in FIG. 2 to that represented by the box 16″ in this figure. If desired, a conventional shaker assembly 80 powered by the motor 82 may be provided to compact the fragile contents within the boxes 16. Also appearing in FIG. 2 are the electrical control panel 84 and the alarm light 86. The alarm light 86 goes on when there is a malfunction of the apparatus causing fruit to back up to the photocell 50, as shown in FIG. 1, for example.

Figure 3:
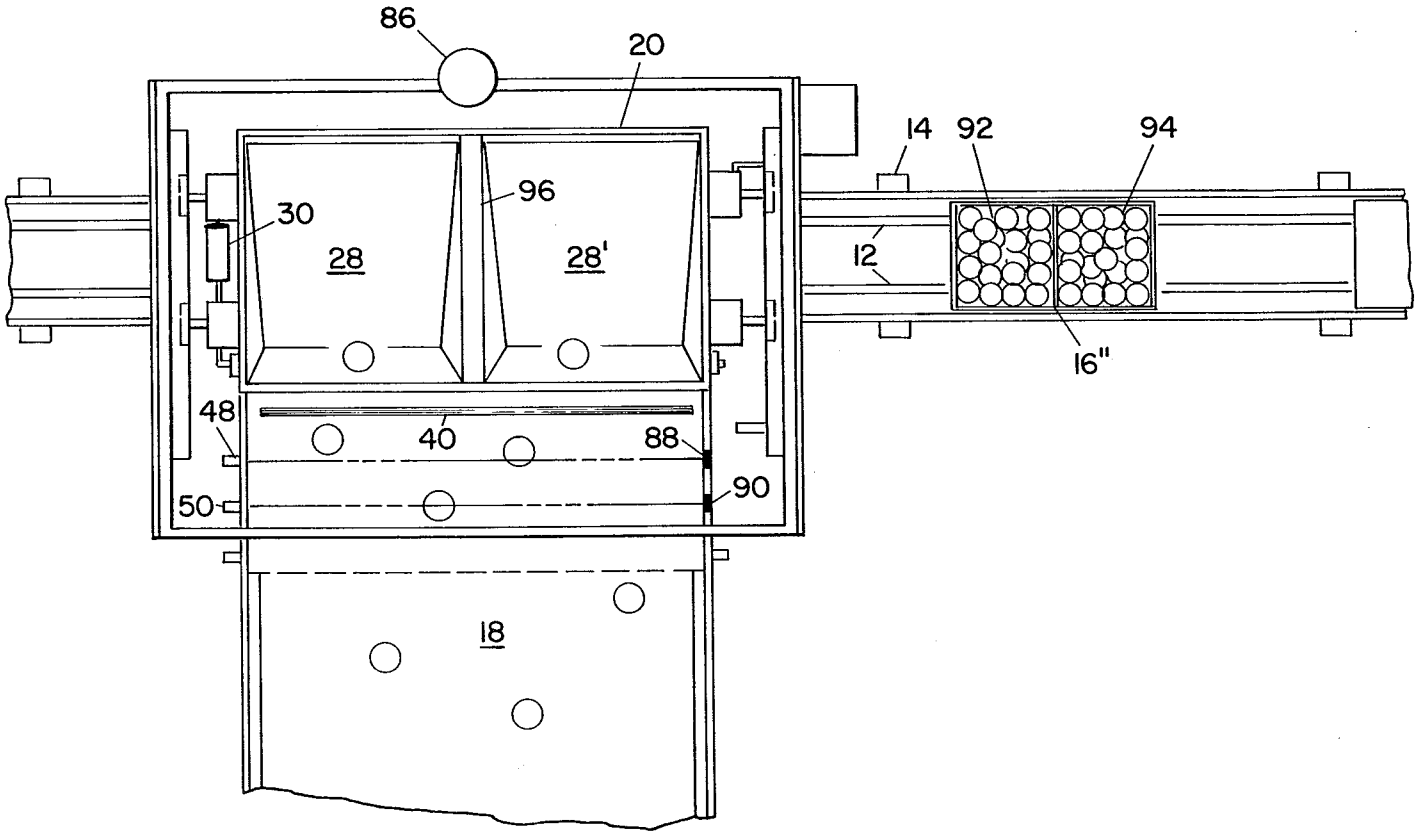
FIG. 3 is top view of the apparatus of FIGS. 1 and 2.

The top view of FIG. 3 is of particular interest in showing the reflectors 88 and 90 associated with the photocell units 48 and 50, respectively. These photocell units 48 and 50 together with their associated reflectors 88 and 90 are standard purchase components wherein both the light source and the photo cell pick up are included in a single unit 48, 50 with the illumination reflected back from reflectors 88 and 90 which are provided with each assembly.

Also to be noted from FIG. 3 is the configuration of the citrus boxes 16 as indicated by box 16''. As indicated in this figure of the drawings, each of the citrus boxes includes two compartments 92 and 94 into which fruit is to be packed evenly, tightly and gently. The receptacle or carriage 20 is divided into two sections by the central divider 96, and is provided with two bottom doors or feeder members 28 and 28' which are operated concurrently by the cylinder 30 as the two bottom doors 28 and 28' are both mounted on a single shaft.

Figure 5:
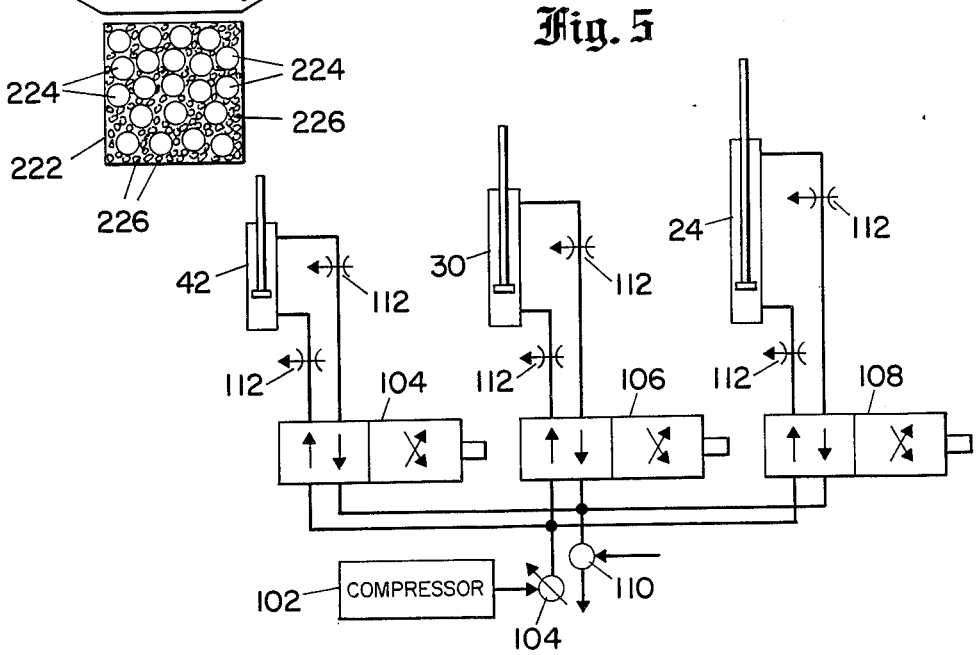
FIG. 5 is a block pneumatic system diagram for the actuation of the air cylinders used in the apparatus of FIGS. 1 through 5.

FIG. 5 is a diagrammatic showing of the pneumatic circuit for actuating the cylinders 24, 30 and 42. It includes a compressor 102, an input valve 103 and three solenoid valves 104, 106, and 108. A fourth solenoid valve 110 operates to close the exhaust from the system in the event of a power failure, thereby holding the cylinder pistons in place. In order to permit the control of the flow of air to and from the pneumatic actuating cylinders 24, 30, and 42, appropriate restricted flow valves 112 are provided so that manual adjustment of the flow rate can easily be accomplished, and delay in actuation introduced when such mode of operation is considered desirable.

Figure 6:
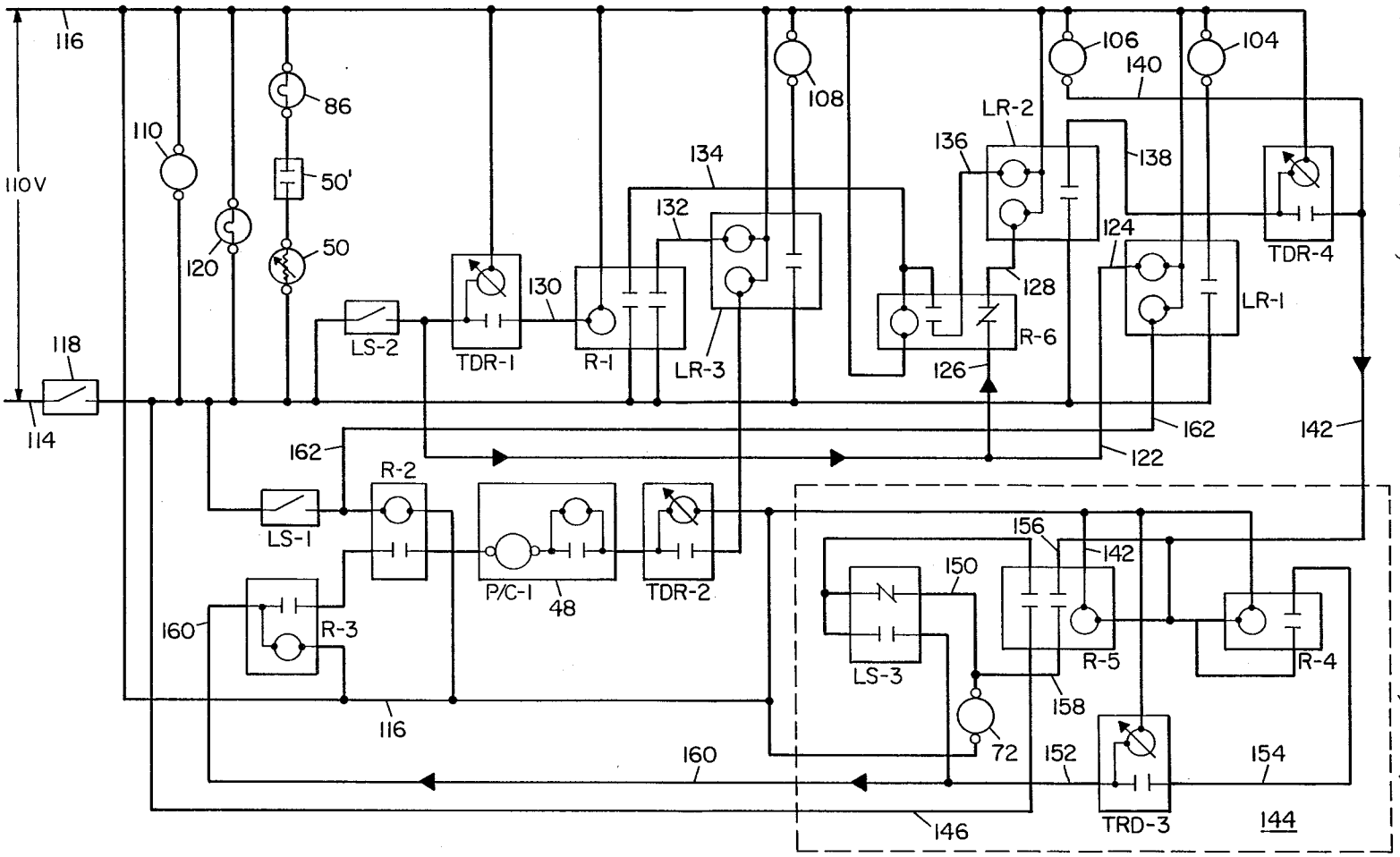
FIG. 6 is a circuit diagram for controlling the sequence of operation of the system of FIGS. 1 through 3.

Consideration will now be given to the electrical schematic diagram of FIG. 6. In FIG. 6, electrical coils associated with relays, valves, or motors for example, are represented by circles, relays are represented by rectangles including a circle representing the relay coil, and switches are enclosed in rectangles. Before going into the details of this figure of the drawings, it may be noted that the three solenoid valves 104, 106 and 108 appear at the upper right in this figure. Input power is applied to the circuit on the leads 114 and 116 and the main power is supplied to the system by the operation of the switch 118. Three limit switches, LS-1, LS-2, and LS-3 are important to the mode of operation of the system and appear in earlier drawings. More specifically, limit switch LS-3 is also designated by the reference number 66 and appears in FIG. 2 to locate the box 16 properly under the carriage 20. It may be noted in passing that LS-3 is closed by the presence of a box 16, and stays closed as the box passes the limit switch and moves out to the position indicated by the box 16'' in FIG. 2. LS-1 and LS-2 are also shown in FIG. 2 and these switches indicate that the carriage 20 is in either its uppermost or its lowermost position. The travel of the three pneumatic cylinders 24, 30 and 42 is determined by their length, and in each case, the cylinders travel for their full extent, and they are not controlled externally by limit switches, but only by the solenoid valves 104, 106 and 108; and when actuated, the pistons travel for the full extent of the throw of the pneumatic cylinders.

Concerning certain overall system matters, when the main switch 18 is energized, solenoid valve 110, is operated to open the exhaust from the system and permit selected actuation of the pneumatic actuators 24, 30, and 42. In addition, the "on" lamp 120 for the system is energized. The photocell unit 50 has associated with it a normally open switch 50' which closes when the photocell beam has been interrupted for a prolonged period of time, and this action serves to turn on the alarm light 86 which has been mentioned hereinabove.

Now, considering the mode of operation of the system in somewhat greater detail, we will assume that the carriage or receptacle 20 is in its lower position, and the limit switch LS-2 is closed. This applies current to lead 122, which in turn applies a pulse to the latching input terminal 124 of the latching relay LR-1, thereby operating solenoid 104 and piston 42 to raise or close the upper door 40. In addition, the branching lead 126 applies an unlatching signal to input 128 of the latching relay LR-2 which releases solenoid 106, thereby permitting the two lower doors 28 and 28' at the bottom of the carriage or receptacle 20 to slowly open, depositing the fragile product or fruit into the two sides of the containers or boxes 16. Incidentally, the exhaust from the cylinder 30 is constricted to some extent by the partial closure of a valve 112, to prevent damage of the fruit which might otherwise occur if the bottom doors 28 and 28' were permitted to open suddenly.

The closure of the limit switch LS-2 also operates the time delay relay TDR-1 after a delay of perhaps one second. This applies an operating signal to input 130 of relay R-1, thereby energizing input 132 to the latching relay LR-3 associated with the main cylinder solenoid valve 108. The main drive cylinder 24 thereupon starts to raise the carriage 20, which has the collateral effect of pulling the lower doors 28 and 28' (which also have served a feeding and loading function) out of the compartmented boxes 16.

The lead 134 is also energized, and this applies a signal to relay R-6 which in turn energizes the latching input 136 to the latching relay LR-2. After a delay caused by the time delay relay TDR-4 included in leads 138 and 140, the solenoid 106 is actuated to energize the pneumatic cylinder 30 which closes the bottom doors 28 and 28'. The lower doors are thus closed, after a delay of a sufficient time period so that they are withdrawn from the box 16 into which the fruit has been fed. The carriage 20 then proceeds to its full upward position, where it arrives with the lower doors being closed, and the gate 40 still in its upward position.

At this point, the upper limit switch LS-1 (see FIG. 2), which senses the upper position of the carriage 20, is actuated and a new cycle is initiated.

Before going into the new cycle of operation of the carriage, however, at the time TDR-4 operates to close the lower doors by operating solenoid 106, a signal is also sent on lead 142 to initiate operation the circuit 144 which controls the conveyor line motor 72. Now, in considering the mode of operation of the conveyor line circuit 144, there are two conditions which we should consider, one with the limit switch LS-3 closed, and the other with the LS-3 switch open. First, when the LS-3 limit switch is open, with no box in position, and the carriage in its upper position with the lower doors closed, then relay R-5 is energized and the contacts included in it are closed. Current is then supplied on the high voltage lead 146 through relay R-5 to lead 148, through the normally closed contacts of limit switch LS-3 on lead 150 to motor 72. This will serve to advance a new box such as box 16' into the position underneath the carriage 20.

However, a more complex situation is present as the previously filled box 16 is moved out from its position underneath the carriage, in the meantime holding the limit switch LS-3 in its operating position with the normally closed contacts open and the normally open contacts closed. The high voltage on lead 148 is then connected through the lower set of contacts in LS-3 to the lead 152, and following a delay introduced by TDR-3, the signal will be applied through lead 154 through the closed contacts of relay R-4, along lead 156 through the closed contacts of relay R-5 to lead 158 and then to the motor 72. Accordingly, the box 16 will be moved from the position shown in FIG. 2 out to the position as indicated at 16'' in this FIG. 2.

Finally, when a new box is in place and ready for loading, an indicating signal will be transmitted from LS-3 along lead 160 to the relay R-3, and its actuation indicates that a box is in place and ready for loading.

Incidentally, when the upper limit switch LS-1 for the carriage 20 is actuated, the lead 162 is energized, unlatching the latching relay LR-1 and operating solenoid 104 to open the upper door 40, thereby permitting fruit to roll down the feedway 38 into the carriage or receptacle 20. Now, when the photocell unit 48 operates to close its circuit, following a delay introduced by the time delay relay TDR-2, the latching relay LR-3 is unlatched by the energization of line 164 and the solenoid 108 controlling the main drive is released, so that the carriage 20 starts to descend to its lower position. In this regard, the valve 112 in the exhaust line from the piston of cylinder 24 may be employed to control the rate of descent.

Subsequently, after the carriage or receptacle 20 reaches its lower position and energizes the limit switch LS-2 the loading operation of the new box starts all over again, as discussed in detail hereinabove.

Figure 7:
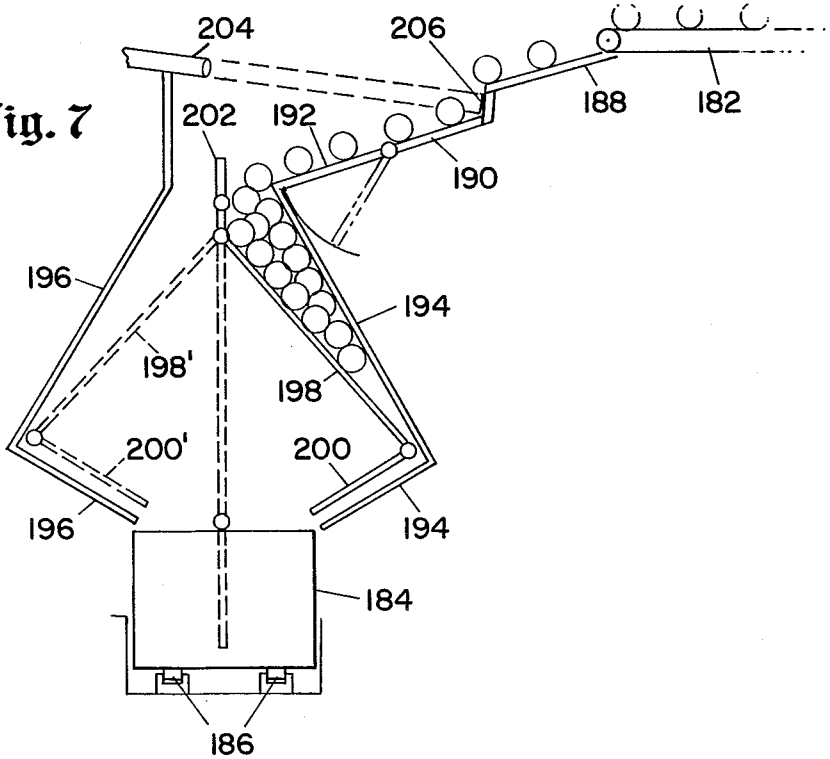
FIG. 7 is diagrammatic side view of an alternative embodiment illustrating the principles of the invention.

FIG. 7 shows an alternative arrangement for feeding fruit from a conveyor 182 for loading the fruit or other fragile product into boxes 184 which are brought into place along a conveyor 186. In the arrangement of FIG. 7, the fruit is brought along a feedway 188, 190, along a pivotting member 192 and into a product feeding chamber including the outer walls 194 and 196. Within the chamber, including the outer walls 194 and 196, is a main pivotting support member 198 to which is pivotally secured at its lower end, a feeding member 200. An additional pivotally mounted member 202 is employed to control the flow of product, by either directing the product in the indicated direction to the right as shown in FIG. 7, or by alignment with the member 192 directing the fruit or other products to the left-hand side of FIG. 7, when the member 198 is in its alternate position 198', as shown in dashed lines in FIG. 7. A photocell assembly 204 with an associated reflecting plate 206 may be employed to determine the level of product stored on the feedways 190 and 192.

In operation, when a suitable level of product has built up between the pivotal member 198 and the wall 194, and on the feedways 192 and 190, the member 198 is slowly moved clockwise as shown in FIG. 7, so that the member 200 extends into the box 184, and product is smoothly deposited within the box 184. As the member 198 pivots to the left-hand position as indicated by line 198', the feeding member 200 is withdrawn from the box 184, and is brought up to the position indicated at 200' in FIG. 7.

Incidentally, it is important to have firm and accurate control of the pivotting of the members 198, 202 and 192 for proper feeding of the product. A suitable type of rotary actuator is available from a company which manufactures such rotary actuators which may be either pneumatically or hydraulically controlled or by any desired combination thereof. The company's name and address is as follows: P. H. D. Inc., P.O. Box 9070, Ft. Wayne, Ind., 46899.

Figure 8:
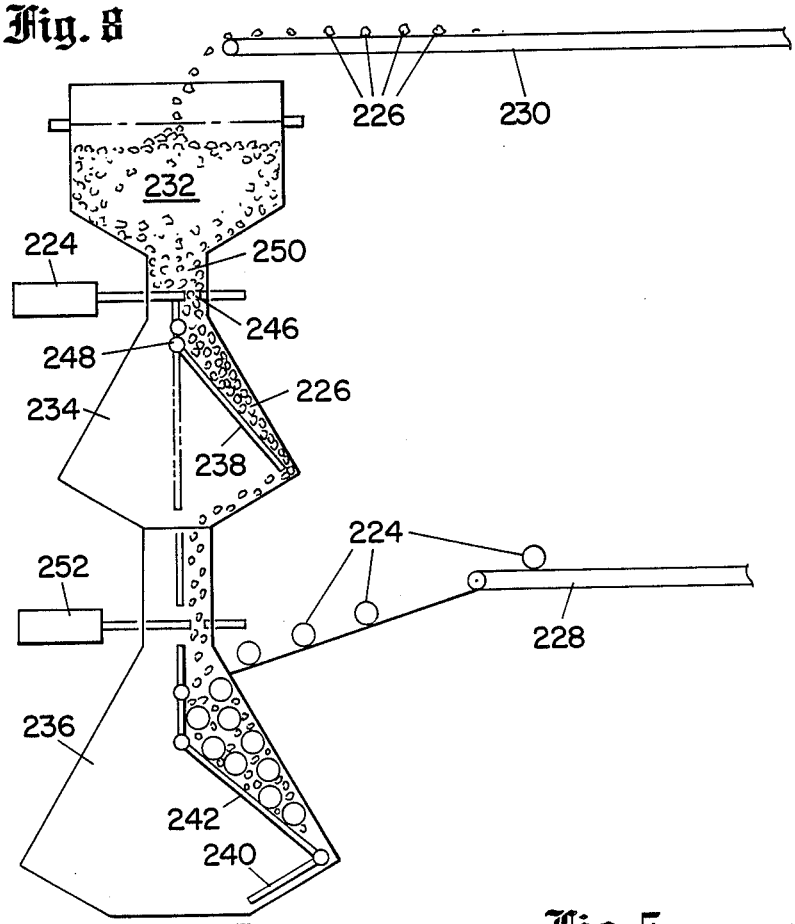
FIG. 8 illustrates an embodiment of the invention in which two different products are packed together.

FIG. 8 shows an alternative embodiment wherein arrangements are provided for measuring precise quantities of two different materials, and loading them together into a single container. More specifically, a container 222 is to be packed both with fruit 224 and also with filler material 226 to protect and cushion the fruit. The fruit 224 may be supplied from an input conveyor belt 228 while the filler material 226 may be supplied from any suitable source 230 into a holding container 232. Two measuring assemblies 234 and 236 which are patterned after the arrangement shown in FIG. 7, are provided to measure the materials and combine them prior to packing into the box 222. Incidentally, the lower unit 236 operates in a manner which is very similar to that of FIG. 7; while the unit 234 is in part similar in the use of the movable member 238, but differs in not requiring the lower pivotal member corresponding to the member 240 shown associated with the main pivotal support member 242 in the lower unit 236 of FIG. 8. Between the holding container 232 and the chamber 234 is a slide door mechanism 244 which shifts an opening 246 from one side to the other of the central pivot point 248 of the unit 234, thereby directing the particular material 226 down either one side or the other of the member 238, or alternatively moving the opening 246 out from the chamber 250 so that none of the particular material may pass through. Similarly, a slide member 252 controls the direction of the measured quantity of filler material to either one side or the other of the pivotal plate 242. It is apparent from FIG. 8, therefore, that either the embodiment of FIGS. 1 through 3, or that of FIG. 7, may be stacked, or operated in parallel, to fill a single container with a combination of materials as may be desired.

Concerning a minor aspect of the construction of all embodiments of the invention, the surfaces which engage the fragile product, such as fruit, are all painted with a resilient rubbery type paint or coating, to cushion the product.

It is again noted that the apparatus and method of measuring product to be transferred is an important aspect of the present invention. One feature of this measurement technique involves the use of a transfer receptacle which is triangular or of reduced cross-section at the point of final filling of the receptacle. Thus, with reference to FIGS. 1 and 4, as the receptacle descends and product is loaded, it reaches the point as shown in FIG. 4 where the addition of a few more lemons will raise the level in the receptacle rapidly. Accordingly, when the generally triangular receptacle 20 is filled and lowered to its unloading position, the raising of the shut-off gate 40 serves to accurately measure the quantity of product in the receptacle.

Further, it may be noted that if the receptacle 20 were not of diminished cross-section as the final loading point is approached, that accurate measurement of total capacity would be more difficult. Thus, if the receptacle or carriage were a rectangular volume, the determination of an exact cut-off point as the top layer was added would necessarily be relatively inaccurate.

It may be noted that, in operation, the arrangement of FIG. 6 is very similar in that, as the member 198 is shifted slowly to the left and approaches the end of member 194, the receptacle for product is again generally triangular, with the final loading point, at the top, being of diminished cross-sectional configuration. Accordingly, control at this top point will accurately control the much greater volume of the enlarged loading receptacle, formed by the side walls 194 and the moving member 198.

In conclusion, it is to be understood that the foregoing description and the accompanying drawings relate to specific illustrative embodiments of the invention. It is to be understood that other construction and embodiments following the principles outlined hereinabove could be employed. Thus, by way of example and not of limitation, compartmented boxes having more individual compartments than the two normally found in citrus fruit boxes could be employed, and two boxes, each having two compartments, making a total of four compartments, could be filled simultaneously using a single unit having four compartments to the carriage, and four separate doors which are pivotted in unison. In addition, resilient padding or brushes may be employed to coat or cover the surfaces into which the fragile product may come into engagement to minimize bruises or damage to the product. Also, a support member may be located near the top of, or extending into a container to be filled, and product may be loaded into a volume of reduced cross-section overlying the fixed support member, and product loaded into the container by withdrawal of the support member. Other changes such as the substitution of one mechanical arrangement for another or one electrical component for another to implement the same function may, of course, be accomplished. Accordingly, it is to be understood that the present invention is not limited to that precisely as shown and described herein.

What is claimed is:

1. A system for measuring and loading product into containers comprising:

means for movably mounting boxes or other containers to be filled at a loading position;

support means for receiving a predetermined quantity of fruit or other products in a volume which equals the capacity of said containers;

means for moving said support means downward toward the container to be filled;

means for feeding the product from said support means into said containers including a product feeding member extending into said containers to control the feeding of said products into said containers, said product feeding member being secured to a lower portion of said support means;

means for raising said support means and said product feeding means to a product receiving location;

means for removing the filled container and for bringing an empty container into the loading position; and means including said support means for defining a substantially closed triangular volume having an apex near the top thereof, for receiving said fruit or other products substantially at said apex of said triangular volume as said triangular volume is being filled;

whereby an accurate and consistent filling of said container is achieved.

2. A measuring and loading system as defined in claim 1 further comprising means for supplying products to said support means, and means for blocking the supply of said products to said support means following a predetermined downward movement of said support means.

3. A measuring and loading system as defined in claim 1 wherein said support means is a carriage which is generally triangular shaped in cross-section, and wherein said product feeding member is a movable door on the bottom of said carriage.

4. A system for measuring and loading as defined in claim 3 wherein said system includes means for feeding product to said carriage near the top of said carriage at a zone of diminished cross-section of said carriage as loading is being completed.

5. A measuring and loading system as defined in claim 3 wherein said system includes means for moving said carriage from an upper initial product receiving position to a lower position at the top of said containers.

6. A measuring and loading system as defined in claim 1 wherein said support means includes a housing and a pivotted support member for holding product between the walls of said housing and the support member.

7. A measuring and loading system as defined in claim 6 including means for directing fragile product first to one side of said support and then to the other.

8. A measuring and loading system as defined in claim 6 wherein said feeding means is an additional member pivotally mounted to the lower end of said support means.

9. A measuring and loading system as defined in claim 1 wherein additional means are provided for adding a measured quantity of another type of material to said products.

10. A measuring and loading system as defined in claim 9 wherein said additional means includes a second support member, and means for gradually lowering said second support member to dispense the other type of material for combination with the product.

11. A packing apparatus for measuring and packing products into containers comprising:

means for supplying products in bulk;

carriage means for receiving said products from said supplying means;

said carriage means having a movable lower door forming the bottom of said carriage;

means for supporting a container to be filled below said carriage;

means for slowly moving said carriage means down toward said container to be filled, with said carriage continuing to receive products from said supplying means;

means for blocking the flow of products from said supplying means to said carriage when said carriage is in proximity to said container;

means for opening said lower door and permitting it to extend into said container to feed said products smoothly into said container;

means for moving said carriage back tp its upper loading position, and for concurrently closing said lower door; and means including said support means for defining a substantially closed triangular volume having an apex near the top thereof, for receiving said products substantially at said apex of said triangular volume as said triangular volume is being filled;

whereby an accurate and consistent filling of said container is achieved.

12. A measuring and packing apparatus as defined in claim 11 wherein said apparatus includes means for mounting said carriage for movement toward and away from said container at an angle in the order of thirty degrees to forty-five degrees from the perpendicular.

13. A packing apparatus as defined in claim 11 wherein said carriage is generally triangular in cross-sectional configuration.

14. A packing apparatus as defined in claim 11 wherein said containers are compartmented, and wherein said carriage is correspondingly compartmented, and includes a plurality of movable lower doors at the bottom of the carriage compartments.

15. A packing apparatus as defined in claim 11 wherein said product supplying means is a conveyor belt.

16. A packing apparatus as defined in claim 11 including conveyor means for bringing containers to and taking containers from a position under said carriage for packing.

17. A system as defined in claim 11 including means for pneumatically moving said carriage and for operating said movable lower door.

18. A method for loading product into containers comprising:

movably mounting boxes or other containers to be filled in a loading location;

loading a support means with a predetermined quantity of fruit or other product in a volume which equals the capacity of said containers;

moving said support means downward toward said container;

feeding said product from said support means into said containers with a feeding member extending into said containers to smoothly feed said product into said containers;

raising said support means and said product feeding means to a product receiving location;

removing the filled container and bringing an empty container into the loading location; and means including said support means for defining a substantially closed triangular volume having an apex near the top thereof, for receiving said fruit or other product substantially at said apex of said triangular volume as said triangular volume is being filled;

whereby an accurate and consistent filling of said container is achieved.

19. A method as defined in claim 18 further including the step of continuing to load product onto the support means while the support means is moving down until a predetermined point is reached, and then cutting off further loading of the support means.

20. A method as defined in claim 18 wherein said support means is a carriage, and including the step of raising said carriage to a product receiving position and lowering said carriage to pack product into said container.

21. A method as defined in claim 18 including the step of shaking said containers after they have been packed.

22. A method as defined in claim 18 including the step of packing additional material into said containers with said fragile products.

23. A system for the measuring and transferring of product comprising:

support means for receiving a predetermined measured quantity of product;

means for receiving said product from said support means, means for moving said support means downward toward said receiving means while product is being supplied thereto;

means associated with said support means for defining a substantially closed product receiving volume which diminishes significantly in cross-section toward the top thereof;

means for feeding said product into the upper end of said product receiving volume where the cross-section thereof is significantly reduced as said volume is being filled; and means for shutting off the feeding of additional product at the upper end of the product receiving volume;

whereby the reduction in cross-section at the upper end of said volume permits very accurate control of the total product included in said product receiving volume; and means for dispensing said product from said support means.

24. A measuring and loading system as defined in claim 23 wherein said support means is a carriage which is generally triangular shaped in cross-section, and wherein said product feeding member is a movable door on the bottom of said carriage.

25. A measuring and loading system as defined in claim 23 wherein said support means includes a housing and a pivoted support member for holding product between the walls of said housing and the support member.

26. A system for measuring product in increments comprising:

means including a support member for defining a predetermined substantially closed volume which diminishes significantly in cross-section toward the top of said volume;

means for supplying product to be measured to substantially fill said volume, and to complete the filling thereof at the top of said volume;

means for stopping the movement of product into said volume as the volume is substantially filled;

means for moving said support member to unload said support member and said volume; and means for shifting said support member back to its initial loading position.

* * * * *